US005676054A

United States Patent [19]

Lubke et al.

[11] Patent Number: 5,676,054

[45] Date of Patent: Oct. 14, 1997

[54] DOCTOR DEVICE FOR INTAGLIO PRINTING MACHINES

[75] Inventors: Herbert Lubke, Lienen; Monika Will, Ladbergen, both of Germany

[73] Assignee: Windmöller & Hölscher, Lengerich, Germany

[21] Appl. No.: 546,755

[22] Filed: Oct. 23, 1995

[30] Foreign Application Priority Data

Nov. 14, 1994 [DE] Germany ..... 44 40 648.7

[51] Int. Cl.[6] ..... B41F 3/81

[52] U.S. Cl. ..... 101/169; 101/157

[58] Field of Search ..... 101/169, 154, 101/155, 157; 118/261

[56] References Cited

U.S. PATENT DOCUMENTS 3,593,663 7/1971 Vischulis ..... 101/350

3,780,670 12/1973 Abler et al. ..... 101/363

FOREIGN PATENT DOCUMENTS 6926396 7/1972 Germany .

3247679 7/1984 Germany .

*Primary Examiner*—Edgar S. Burr

*Assistant Examiner*—Dave A. Ghatt

*Attorney, Agent, or Firm*—Keck, Mahin & Cate

[57] ABSTRACT

The invention pertains to a doctor device for intaglio printing machines with a doctor blade displaceable relative to the printing cylinder, the working stroke of which is adjustable. In keeping with the invention, a motor-driven swash plate rigidly affixed to the frame actuates the doctor blade along with a displaceable doctor beam.

3 Claims, 1 Drawing Sheet

DOCTOR DEVICE FOR INTAGLIO PRINTING MACHINES

FIELD OF THE INVENTION

The invention pertains to a doctor device for intaglio printing machines.

BACKGROUND OF THE INVENTION

A doctor device for intaglio printing machines is known from DE 6,926,396 U. Such a doctor device includes a doctor blade, which is moved axially back and forth relative to the printing roller and fits with a longitudinal edge on the periphery of the printing cylinder at a setting angle usually greater than 90° C. The back-and-forth movement of the doctor blade of the known doctor device is accomplished by a chain drive, the chain of which is affixed on one side to the doctor blade and, is displaceable back and forth via a reversing gear by a revolving drive gear with constant rotational speed, while this reversing gear is redirected by terminals in the end positions of the doctor. The construction of such reversing gears is very complicated. On the other hand, the reversing gear undergoes a time lag with each change of direction. This is especially disruptive when short pivoting movements are executed.

SUMMARY OF THE INVENTION

Consequently, the objective of the invention is to modify a doctor device of this general type in such a way that the doctor drive works more simply and that the operation is continuous even when the working strokes of the doctor blade are short.

Proceeding from a generic doctor device, this objective is realized in keeping with the invention by the characteristics of the doctor blade, together with a doctor beam displaceably guided in a retainer, which is actuated by a motor-driven swash plate rigidly affixed to the frame. This doctor device of the invention works especially simply and permits a continuous setting of the driving stroke of the doctor blade.

In one practical embodiment of the invention, the edge section of the swash plate runs on rollers secured to the doctor beam.

The working stroke of the doctor blade is preferably adjustable by the setting of the degree of pivoting of the swash plate. Here the degree of pivoting can be set by an adjustment lever, which is adjustable by means of a handwheel.

BRIEF DESCRIPTION OF THE DRAWINGS

Further details and advantages of the invention are described more closely with references to an embodiment example illustrated in the appended drawings. These depict.

DETAILED DESCRIPTION OF THE PREFERRED EMBODIMENTS

Figure 2:
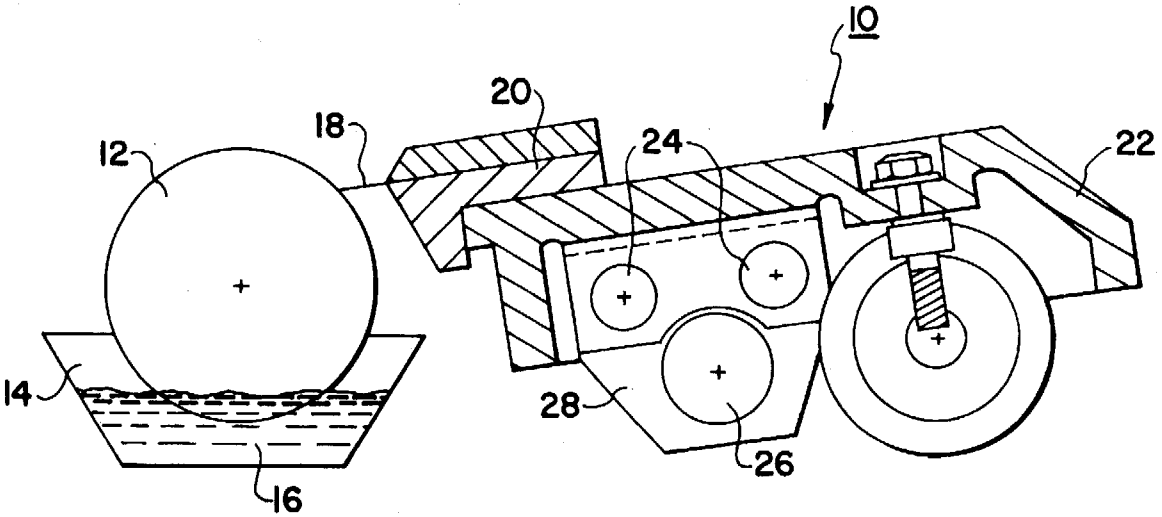
FIG. 2: a cross section along Line I—I in FIG. 1.

The doctor device (10) is depicted in its working position in FIG. 2. To this end, a doctor blade (18) is placed against a printing cylinder (12), which dips in a known manner into printing ink (16) in an ink vat (14). The doctor blade (18) is set in a blade retainer (20), which is mounted on a doctor beam (22). The doctor beam (22) moves back and forth on guide rods (24) in a direction perpendicular to the plane of the drawing. The guide rods (24) are securely joined to lateral retainers (28) in a manner not further depicted. The lateral retainers (28) are nontorsionally secured to an axle (26), which is mounted in a similarly not further depicted crossbar, which is itself mounted in a not further depicted base of the printing machine in such a way as to be upwardly and downwardly displaceable.

Figure 1:
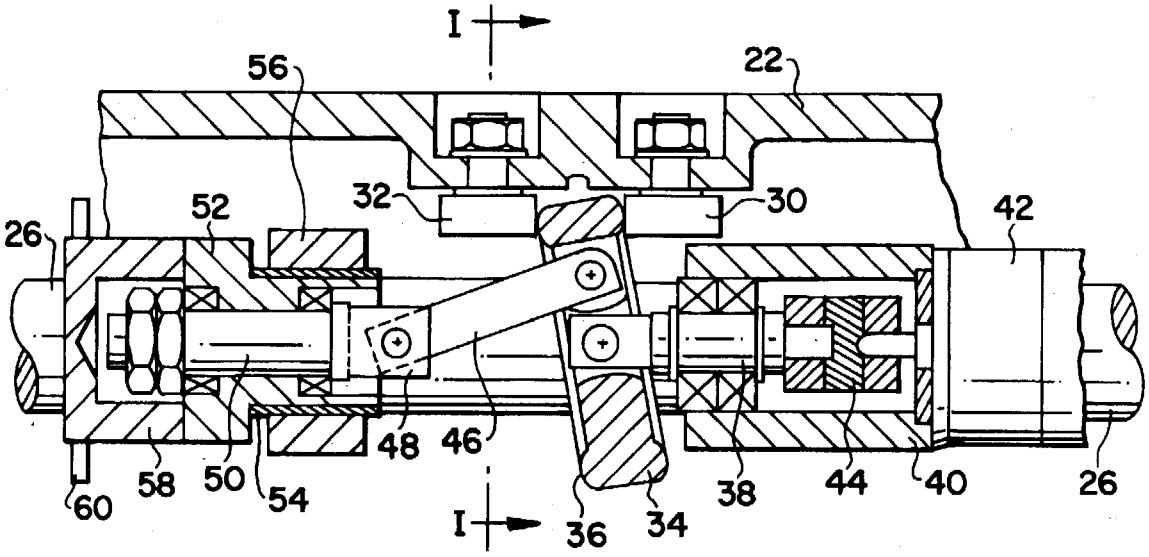
FIG. 1: a cross section through a part of an embodiment of a doctor device according to the invention.

The drive of the back and forth movement, i.e., the translational movement, of the doctor beam (22), and therefore of the doctor blade (18), can be described in greater detail with reference to FIG. 1. Affixed to the doctor beam (22) are two rollers (30,32), between which a swash plate runs in the configuration depicted in FIG. 1. The edge section (36) of the swash plate (34) is spherically turned, so that the edge section can run smoothly along the rollers (30,32) even when the swash plate (34) is obliquely canted. The swash plate (34) is mounted on a journal (38), which is mounted via suitable pivot bearings in a housing (40). The housing (40) is firmly joined to the axle (26). Flanged onto the housing (40) is an electromotor (42), which is shown in partial cutaway in FIG. 1. The drive shaft of the electromotor (42) is joined to the journal (38) by a coupling (44). By means of the speed of the electromotor, the translational movement of the doctor beam (22), and therefore of the doctor blade (18), is adjusted.

The swash plate (34) is engaged by an adjustment lever (46), with which the cant of the swash plate and therefore the working stroke of the doctor blade (18) can be adjusted. The adjustment lever (46) engages in a fork (48) of a shaft section (50), which is rotationally mounted in a flange (52). This flange (52) has male threads (54), by means of which it is threaded into an axially fixed plate (56). The threaded flange (52) can then be manually rotated in relation to the plate (56) by means of a cover (58) joined to it and spokes (60) mounted thereon which together form a handwheel. Here the flange is either screwed into or screwed out of the plate (56). The adjustment lever (46) and therefore the degree of pivoting of the swash plate (34) is set thereby. Accordingly, the working stroke of the doctor blade (18) can be continuously adjusted with appropriate rotation of the flange (52).

What is claimed is:

1. A doctor device for intaglio printing machines comprising:

a frame, a doctor blade, a doctor beam, means for mounting said doctor beam for displacement relative to a printing cylinder, and means for adjusting the displacement of said doctor beam, the doctor blade being mounted on said doctor beam to provide the doctor blade with an adjustable working stroke in which the doctor blade moves axially back and forth relative to the printing cylinder, said means for mounting said doctor beam for displacement further comprising a motor-driven swash plate which is rigidly affixed to said frame and which drives the doctor blade and the displaceable doctor beam, wherein the working stroke of the doctor blade is adjustable in length, axially back and forth along the printing cylinder.

2. A doctor device according to claim 1, wherein the swash plate comprises an edge section which runs on rollers secured to the doctor beam.

3. A doctor device according to claim 1, wherein the swash plate is pivotable to a degree set by an adjustment lever.

* * * * *